US011417970B2

(12) United States Patent
Fukushima et al.

(10) Patent No.: US 11,417,970 B2
(45) Date of Patent: Aug. 16, 2022

(54) HERMETIC TERMINAL WITH IMPROVED ADHESION OF GLASS SEAL TO HIGH POWER LEAD

(71) Applicant: SCHOTT Japan Corporation, Koka (JP)

(72) Inventors: Daisuke Fukushima, Koka (JP); Hiroki Honda, Koka (JP); Naoki Kobayashi, Koka (JP)

(73) Assignee: SCHOTT JAPAN CORPORATION, Shiga (JP)

( * ) Notice: Subject to any disclaimer, the term of this patent is extended or adjusted under 35 U.S.C. 154(b) by 20 days.

(21) Appl. No.: 16/769,708

(22) PCT Filed: Mar. 7, 2018

(86) PCT No.: PCT/JP2018/008750
§ 371 (c)(1),
(2) Date: Jun. 4, 2020

(87) PCT Pub. No.: WO2019/116598
PCT Pub. Date: Jun. 20, 2019

(65) Prior Publication Data

US 2020/0388940 A1 Dec. 10, 2020

(30) Foreign Application Priority Data

Dec. 12, 2017 (JP) ..... JP2017-237670

(51) Int. Cl.
*H01R 9/16* (2006.01)
*H01R 13/03* (2006.01)
(Continued)

(52) U.S. Cl.
CPC ..... *H01R 9/16* (2013.01); *H01R 13/03* (2013.01); *H01R 13/521* (2013.01); *H01R 13/533* (2013.01)

(58) Field of Classification Search
CPC ..... H01R 9/16; H01R 13/533; H01R 13/521; H01R 13/03; H01R 13/5216
(Continued)

(56) References Cited

U.S. PATENT DOCUMENTS 3,992,774 A * 11/1976 Burrer ..... H01R 9/00 29/854
4,580,003 A 4/1986 Bowsky et al.
(Continued)

FOREIGN PATENT DOCUMENTS

CN 204936367 U 1/2016
JP 56-77087 A 6/1981
(Continued)

OTHER PUBLICATIONS

PCT Examiner Miki Kobayashi, PCT International Preliminary Report on Patentability including English Translation of PCT Written Opinion of the International Searching Authority for International Application PCT/JP2018/008750, dated Jun. 16, 2020, 5 pages, International Bureau of WIPO, Geneva, Switzerland.
(Continued)

*Primary Examiner* — Travis S Chambers
(74) *Attorney, Agent, or Firm* — Keating and Bennett, LLP

(57) ABSTRACT

There is provided a hermetic terminal for a large amount of power so as to secure wettability of a lead member to glass and improve hermetic reliability of a glass sealing portion. A hermetic terminal includes: a metal base provided with at least one through hole; a lead inserted in the through hole of the metal base; and an insulating member that seals the lead in the metal base. The lead includes: a core member; a binding member that at least coats an outer diameter portion of the core member; an intermediate member that coats a surface of the binding member and that is composed of a
(Continued)

low-electric-resistance material; and an outer coating member that coats the intermediate member and that has a stable glass binding characteristic at a sealing temperature.

18 Claims, 3 Drawing Sheets

(51) Int. Cl.
*H01R 13/533* (2006.01)
*H01R 13/52* (2006.01)

(58) Field of Classification Search
USPC ..... 439/887
See application file for complete search history.

(56) References Cited

U.S. PATENT DOCUMENTS

| | | | | |
|---|---|---|---|---|
| 5,584,716 | A * | 12/1996 | Bergman | H01R 13/5202 174/152 GM |
| 6,509,525 | B2 * | 1/2003 | Honkomp | H01B 17/303 174/152 GM |
| 8,794,999 | B2 * | 8/2014 | Schuckmann | H01R 13/44 439/587 |
| 2016/0300633 | A1 * | 10/2016 | Altstadt | C22C 38/105 |

FOREIGN PATENT DOCUMENTS

| | | | |
|---|---|---|---|
| JP | 61-260560 | A | 11/1986 |
| JP | 63-246802 | A | 10/1988 |
| JP | 01-245913 | A | 10/1989 |
| JP | 2017-084634 | A | 5/2017 |
| JP | 2017-112082 | A | 6/2017 |

OTHER PUBLICATIONS

Chinese Office Action and Search Report dated Dec. 17, 2020 in Chinese Patent Application No. 201880080093.X, 6 pages, with partial English translation, 4 pages.
English translation of PCT International Search Report of the International Searching Authority for International Application PCT/JP2018/008750, dated May 15, 2018, 1 page, Japanese Patent Office, Tokyo, Japan.
Japanese Industrial Standard JIS H 4541: 1997, Dumet Wires, revised Feb. 20, 2009, 5 pages, with English translation, 9 pages.
European Examiner Maria Kandyla, Extended European Search Report and Examination Report for European Patent Application No. 18889720.1, dated Jun. 23, 2021, 8 pages, European Patent Office, Munich, Germany.
Chinese Office Action and Search Report dated Jul. 7, 2021 in Chinese Patent Application No. 201880080093.X, 6 pages, with partial English translation, 4 pages.

* cited by examiner

HERMETIC TERMINAL WITH IMPROVED ADHESION OF GLASS SEAL TO HIGH POWER LEAD

TECHNICAL FIELD

The present invention relates to a hermetic terminal.

BACKGROUND ART

In a hermetic terminal, a lead is hermetically sealed in an insertion hole of a metal base with an insulating member being interposed therebetween. Such a hermetic terminal is used when a current is supplied to an electrical device or element housed inside a hermetic container, or when a signal is sent from the electrical device or element to outside. GTMS (Glass-to-Metal-Seal) type hermetic terminals, in each of which a lead is sealed in a metal base with insulating glass, are roughly classified into the following two types: a matched sealing type hermetic terminal; and a compression sealing type hermetic terminal.

In order to secure highly reliable hermetic sealing in the hermetic terminal, it is important to appropriately select: a thermal expansion coefficient of a metal material of each of the base and the lead; and a thermal expansion coefficient of the insulating glass. The insulating glass for sealing is determined based on materials, required temperature profiles and thermal expansion coefficients of the metal base and the lead.

In the case of the matched sealing, a material of the insulating glass is selected such that the thermal expansion coefficient of the metal material and the thermal expansion coefficient of the insulating glass match with each other as much as possible. On the other hand, in the case of the compression sealing, in order for the metal base to compress the insulating glass and the lead, materials having different thermal expansion coefficients are intentionally selected for the metal material and the insulating glass.

In the conventional matched sealing type hermetic terminal, a Kovar alloy (Fe: 54%, Ni: 28%, Co: 18%) having the same thermal expansion coefficient as that of the glass material in a wide temperature range is used for the metal base and the lead member in order to secure high hermetic reliability and electric insulation. The lead member is sealed in the metal base with an insulating glass composed of borosilicate glass. The conventional compression sealing type hermetic terminal employs a metal base composed of a steel such as carbon steel or stainless steel, and a lead member composed of an iron alloy such as an iron nickel alloy (Fe: 50%, Ni: 50%) or an iron chromium alloy (Fe: 72%, Cr: 28%) in order to apply concentric compressive stress to glass in a use temperature range. The lead member is sealed in the metal base with an insulating glass composed of soda barium glass.

An exemplary metal wire member sealed in a soft glass sealing portion of each of an electron tube, an electric bulb, a discharge lamp, and a semiconductor device such as a diode or a thermistor is a Dumet wire. The Dumet wire is a composite wire obtained by using an iron-nickel alloy for a core member, coating the core member with copper, and oxidizing or borating a surface thereof.

CITATION LIST

Patent Literature

PTL 1: Japanese Patent Laying-Open No. 61-260560

Non Patent Literature

NPL 1: Japanese Industrial Standard JIS H 4541-1997, Dumet Wire

SUMMARY OF INVENTION

Technical Problem

In recent years, a hermetic terminal has been required to handle a large amount of power. For example, small and high-performance compressors have been required for refrigerators installed in shops with limited spaces such as convenience stores. Thus, each of such compressors mainly for business use in recent years tends to have a smaller size than a conventional size; however, in response to improved performance of the refrigerators, the maximum value of current flowing through a hermetic terminal attached to the compressor tends to be increased accordingly.

Conventionally, in a hermetic terminal for refrigerators, a high-resistance metal such as an iron alloy has been used for a lead member in view of a constraint in a mechanical strength or the like required for a lead pin. Therefore, when an electric overload is applied, insulating glass is melted due to Joule heat of the lead member, with the result that hermeticity cannot be secured. In the worst case, this may lead to falling-off of the lead member. Particularly, for an application involving a large amount of power, in view of handling of the large amount of power and efficient utilization of electrical energy such as power saving, it is more preferable to suppress generation of heat resulting from applied power in the lead member of the hermetic terminal.

If the conventional lead member composed of an iron alloy is changed to a lead member composed of a low-resistance metal such as copper or an aluminum alloy, inconvenience is caused due to the following reason: such a low-resistance material has a mechanical strength lower than that of the iron alloy and the lead pin is likely to be bent during assembly or installation. Since the insulating glass used for sealing is generally a material having a low thermal expansion coefficient, the matched sealing cannot be employed in principle if a material having a high thermal expansion coefficient, such as silver, copper, aluminum, a silver alloy, a copper alloy, or an aluminum alloy, is used for the lead member.

The thermal expansion coefficient of the low-resistance metal is larger than that of the steel material used for the metal base. When the low-resistance metal is used for the lead member in the compression sealing, the lead member is contracted greatly after the sealing. Accordingly, compressive stress applied from the insulating glass becomes too small, with the result that it becomes difficult to secure hermeticity. Nevertheless, it can be also considered to form each of the metal base and the lead member using a material having a high thermal expansion coefficient such as silver, copper, aluminum, or each of alloys thereof; however, in that case, compressive stress applied to the insulating glass becomes too large, with the result that the insulating glass may be cracked. Hence, this cannot be employed.

In order to reduce electric resistance of a lead member, a hermetic terminal employing a copper core lead has been proposed. As illustrated in Patent Literature 1, there is a hermetic terminal employing a composite lead member in which a surface of a copper core is coated with an alloy steel. In the lead member of the hermetic terminal of Patent Literature 1, an outer jacket composed of an alloy steel is fixed to and coats a surface of an inner core composed of copper.

When the diameter of the inner core composed of copper is made large and the outer jacket composed of the alloy steel is made thin, the mechanical strength of the lead cannot be maintained due to a constraint in placement of the lead in the metal base having a limited size. Moreover, the outer jacket composed of the alloy steel cannot withstand large thermal expansion of copper and follows it, with the result that sufficient compression sealing cannot be obtained. On the other hand, when the diameter of the inner core is made small and the outer jacket composed of the alloy steel is made thick, it becomes difficult to obtain a desired resistance value of the lead.

Moreover, when the lead is provided with a mechanical strength in a practical range, the outer jacket composed of the steel material serves as a current path and is certainly fed with power. Since the outer jacket composed of the alloy steel has an electric resistance several ten times as large as that of copper, a large amount of heat is generated in the steel material portion even though generation of heat is suppressed in the copper material portion. The generation of heat in the steel material is suppressed by making the copper core thicker in order to suppress application of power to the steel material, with the result that a thermal stress between the lead and the glass can be small. Instead, a large thermal stress is caused between the steel material and the copper material at the power-applied side, with the result that detachment is likely to occur at a material interface.

Thus, the configuration with the outer jacket composed of the steel material and the inner core composed of the copper material provides the effect of decreasing the electric resistance of the copper core member, but presents the problem resulting from the excessive thermal expansion of the copper core member. In the configuration with the outer jacket composed of the steel material and the inner core composed of the copper material, detachment occurs at the interface due to a thermal stress, with the result that the composite interface between the metal materials is affected by thermal hysteresis. Accordingly, hermeticity is likely to be deteriorated.

The Dumet wire, which has been conventionally used as an electrode member to be sealed with glass, is obtained by oxidizing or borating a surface of a composite wire in which an iron-nickel alloy serving as a core member is coated with copper. The Dumet wire is defined in, for example, Non-Patent Literature 1, i.e., Japanese Industrial Standard or the like.

When manufacturing such a Dumet wire, a copper coating is provided on the core wire composed of the iron-nickel alloy. The copper surface is oxidized into copper(I) oxide ($Cu_2O$) at 950° C. Subsequently, it is immersed in a boric acid solution, and is then pulled up. The boric acid ($H_3BO_3$) adhered thereto is decomposed and calcinated at 800 to 950° C., thereby generating boron oxide ($B_2O_3$) at the outermost surface in the form of glass.

Although this manufacturing method gains a profit in the case of a consecutive process involving sending out a flexible long-length wire member using a reel, production efficiency is low when performing the film formation in a similar manner in a batch process using individual rigid large-diameter pins, thus resulting in high cost, disadvantageously. Moreover, in the batch process using individual large-diameter pins, a multiplicity of pin members are more likely to be brought into contact with each other or collide with each other. This causes unevenness or detachment of the borate film. At a portion at which the borate film is thin or a portion from which the borate film has fell off, conformability or adhesion of the glass becomes deteriorated, thus facilitating occurrence of leakage, disadvantageously. Therefore, the Dumet wire only has a comparatively small diameter for use in a bulb tube for a lighting tool or the like. It is difficult to apply this to a hermetic terminal for a large amount of power.

In the Dumet wire, the core member composed of the Fe-based metal is coated with the copper material. By chemically binding silicate or borate of insulating glass to a copper oxide layer on a surface of the copper material, the Dumet wire is sealed with the insulating glass. The boron oxide film provided to coat the outermost surface of the Dumet wire in the form of glass is preliminarily chemically reacted with copper oxide as well as boron oxide of the glass component. By improving wettability of the insulating glass with the boron oxide film, sealing can be attained in a short time. Moreover, the boron oxide film has a function of preventing excessive reaction between the insulating glass and the copper oxide to protect the oxide layer located at a joining surface between the copper foundation and the sealing glass.

Generally, there are the following two types of copper oxides: red-colored copper(I) oxide ($Cu_2O$); and black-colored copper(II) oxide (CuO). Since copper(II) oxide is brittle, only copper(I) oxide exhibits excellent sealability when reacted with glass. However, copper(I) oxide is likely to be dissolved in glass. When glass is directly provided on a sole copper foundation for the purpose of sealing, the oxide layer, which binds the glass and the metal, may be diffused in the glass to cease to exist or may be partially converted into copper(II) oxide. From these portions, leakage is likely to occur, disadvantageously.

An object of the present invention is to provide a hermetic terminal for a large amount of power so as to secure wettability of a lead member to glass and improve hermetic reliability of a glass sealing portion.

Solution to Problem

A hermetic terminal according to one embodiment of the present invention includes: a metal base provided with at least one through hole; a lead inserted in the through hole of the metal base; and an insulating member that seals the lead in the metal base. The lead includes: a core member; a binding member that at least coats an outer diameter portion of the core member; an intermediate member that has adhesion to the binding member, that coats a surface of the binding member, and that is composed of a low-electric-resistance material; and an outer coating member that coats the intermediate member and that has a stable glass binding characteristic at a sealing temperature.

Since the binding member is provided on the surface of the core member, the adhesion between the core member and the intermediate member can be improved. Since the outer coating member having a stable glass binding characteristic at the sealing temperature is provided on the outermost surface of the lead, sealing hermeticity can be readily secured even when an intermediate member inferior in adhesion with glass is used. Accordingly, an outer coating member can be formed through plating finishing, cladding finishing, or the like on a large-diameter pin on which it has been conventionally difficult to form a borate. Hence, it is possible to readily obtain a surface coating having such a stable glass binding characteristic that corrosion due to reaction with glass is less likely to occur.

DESCRIPTION OF EMBODIMENTS

Figure 1:
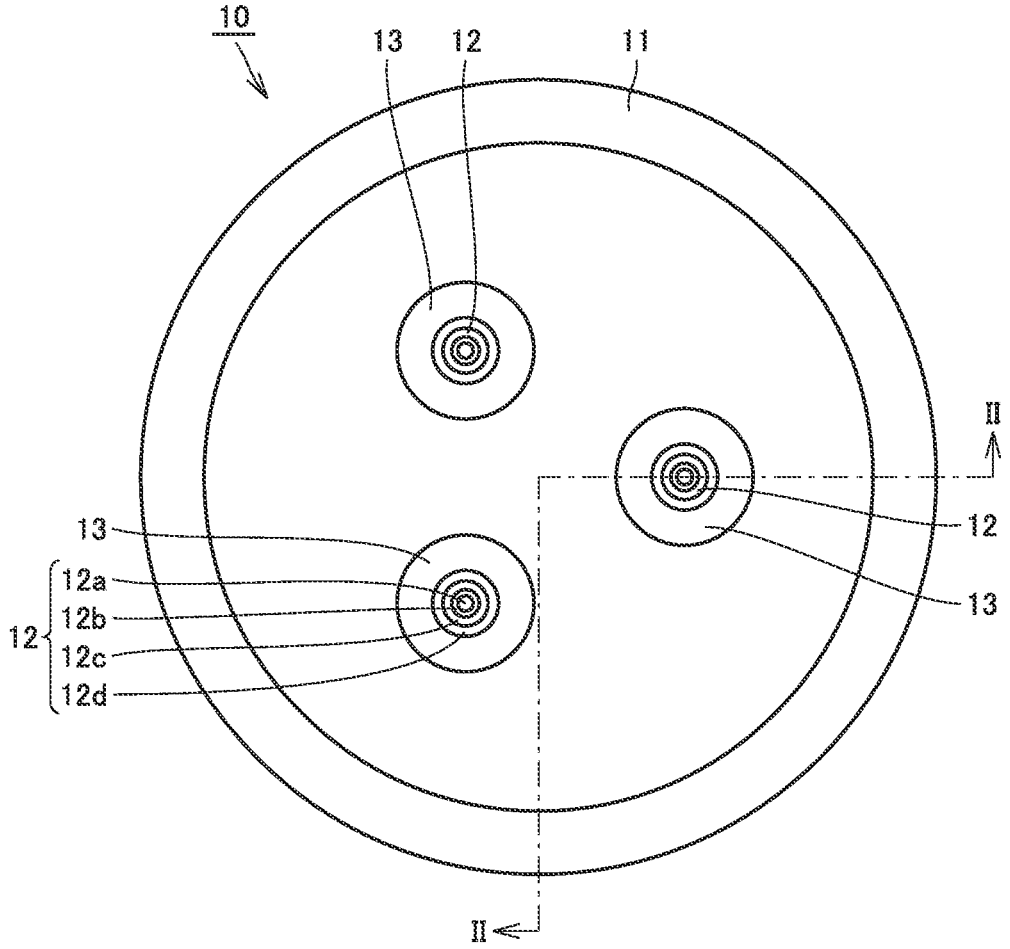
FIG. 1 is a plan view showing a hermetic terminal according to the present invention.
Figure 2:
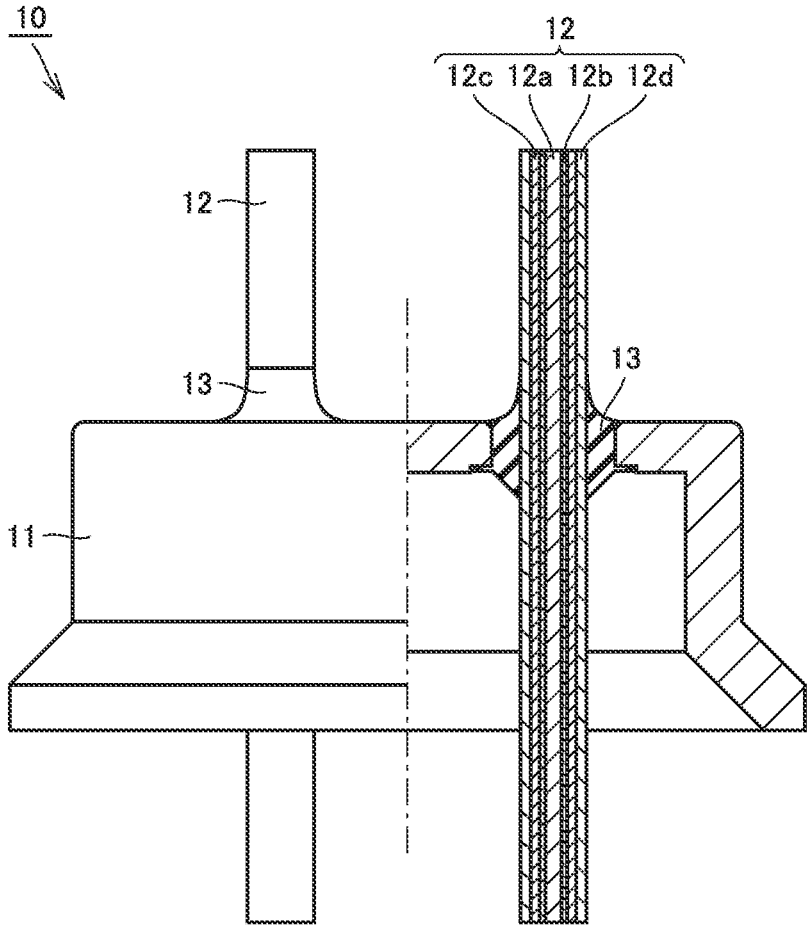
FIG. 2 is a front partial cross sectional view showing the hermetic terminal according to the present invention and taken along a II-II line of FIG. 1.
Figure 3:
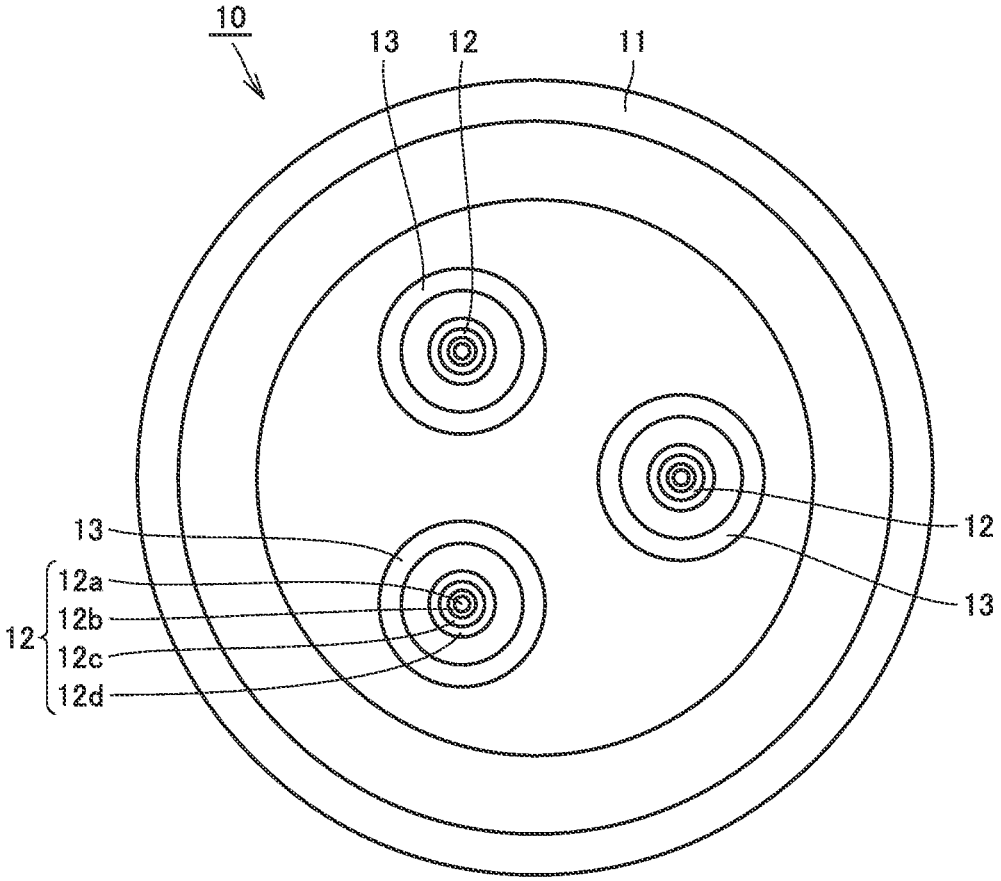
FIG. 3 is a bottom view showing the hermetic terminal according to the present invention.

As shown in FIG. 1 to FIG. 3, a hermetic terminal 10 according to the present embodiment includes: a metal base 11 provided with at least one through hole; a lead 12 inserted in the through hole of metal base 11; and an insulating member 13 that seals lead 12 in metal base 11. Lead 12 includes: a core member 12*a* serving as a structural member; a binding member 12*b* that at least coats an outer diameter portion of core member 12*a*; an intermediate member 12*c* that coats a surface of this binding member 12*b* and that is composed of a low-electric-resistance material; and an outer coating member 12*d* that coats a surface of intermediate member 12*c* and that has a stable glass binding characteristic at a sealing temperature. Since the surface of intermediate member 12*c* composed of the low-electric-resistance material is coated with outer coating member 12*d* having a stable glass binding characteristic at the sealing temperature, adhesion with the glass can be secured by outer coating member 12*d* on the surface while the low-electric-resistance material having low adhesion with the glass is disposed as intermediate member 12*c*.

Core member 12*a* of the present embodiment is composed of Fe or a Fe-based alloy for the structural member. Any material may be used for binding member 12*b* of the present invention as long as the material has affinity to core member 12*a* and intermediate member 12*c* and is unlikely to be diffused into core member 12*a* and intermediate member 12*c*. For example, as binding member 12*b*, Ni, Cu, Ag, a Ni alloy, a Cu alloy, or an Ag alloy can be used suitably.

Any material may be used for intermediate member 12*c* of the present embodiment as long as the material is a low-electric-resistance material exhibiting an electric resistance value comparable to or less than or equal to an electric resistance value of a copper material. For example, as intermediate member 12*c*, a metal composed of Cu or Al, or an alloy including more than or equal to 5 weight % of at least one of Cu and Al can be suitably used.

Any material may be used for outer coating member 12*d* of the present embodiment as long as the material is an outer coating member having a stable glass binding characteristic at a sealing temperature of more than or equal to 600° C. and less than or equal to 1100° C. For example, outer coating member 12*d* is composed of one of metals composed of transition elements in groups 6A to 8 except for Tc in a long periodic table, or is composed of an alloy including more than or equal to 5 weight % of at least one of the metals. At the sealing temperature, a compound, such as an oxide thereof, on a surface of such an outer coating member 12*d* or the metal thereof itself is slowly dissolved in glass. Therefore, even when the film thicknesses of the compound on the surface and the metal are thin, a cracked portion otherwise resulting from reaction with the glass is less likely to be formed. Hence, this is suitable. Particularly, an outer coating member 12*d* composed of a metal selected from a group of Cr, Ni, Ni—P, and Pd can be used suitably.

According to the above-described configuration, while using, for intermediate member 12*c*, the low-electric-resistance material having low adhesion with the glass, outer coating member 12*d* prevents excessive reaction with the sealing glass at the lead interface of the hermetic terminal, thus attaining sealing with excellent hermeticity. Moreover, outer coating member 12*d* may be partially provided only at the interface with insulating member 13.

It should be noted that a hermetic terminal with three terminals is illustrated in the present specification and figures; however, any form of hermetic terminal may be employed as long as a lead is sealed in a base with glass. The hermetic terminal is not limited to the one illustrated therein.

EXAMPLES

As shown in FIG. 1 to FIG. 3, a hermetic terminal 10 according to an Example 1 includes: a metal base 11 that is provided with three through holes and that is composed of carbon steel; leads 12 inserted in the respective through holes of metal base 11; and insulating members 13 that seal leads 12 in metal base 11 and that are each composed of soda barium glass. Each of leads 12 includes: a core member 12*a* composed of a Fe—Cr alloy; a binding member 12*b* that coats an outer diameter portion of core member 12*a* and that is composed of Ni; an intermediate member 12*c* that coats a surface of binding member 12*b* and that is composed of Cu; and an outer coating member 12*d* that coats a surface of intermediate member 12*c* and that is composed of Cr.

As shown in FIG. 1 to FIG. 3, a hermetic terminal 10 according to an Example 2 includes: a metal base 11 that is provided with three through holes and that is composed of carbon steel; leads 12 inserted in the respective through holes of metal base 11; and insulating members 13 that seal leads 12 in metal base 11 and that are each composed of soda barium glass. Each of leads 12 includes: a core member 12*a* composed of a Fe—Cr alloy; a binding member 12*b* that coats an outer diameter portion of core member 12*a* and that is composed of Ni; an intermediate member 12*c* that coats a surface of binding member 12*b* and that is composed of Cu; and an outer coating member 12*d* that coats a surface of intermediate member 12*c* and that is composed of Ni.

As shown in FIG. 1 to FIG. 3, a hermetic terminal 10 according to an Example 3 includes: a metal base 11 that is provided with three through holes and that is composed of carbon steel; leads 12 inserted in the respective through holes of metal base 11; and insulating members 13 that seal leads 12 in metal base 11 and that are each composed of soda barium glass. Each of leads 12 includes: a core member 12*a* composed of a Fe—Cr alloy; a binding member 12*b* that coats an outer diameter portion of core member 12*a* and that is composed of Ni; an intermediate member 12*c* that coats a surface of binding member 12*b* and that is composed of Cu; and an outer coating member 12*d* that coats a surface of intermediate member 12*c* and that is composed of Pd.

As shown in FIG. 1 to FIG. 3, a hermetic terminal 10 according to an Example 4 includes: a metal base 11 that is provided with three through holes and that is composed of stainless steel; leads 12 inserted in the respective through holes of metal base 11; and insulating members 13 that seal leads 12 in metal base 11 and that are each composed of soda barium glass. Each of leads 12 includes: a core member 12*a* composed of a Fe—Cr alloy; a binding member 12*b* that coats an outer diameter portion of core member 12*a* and that is composed of Cu; an intermediate member 12*c* that coats a surface of binding member 12*b* and that is composed of Al; and an outer coating member 12*d* that coats a surface of intermediate member 12*c* and that is composed of Cr.

As shown in FIG. 1 to FIG. 3, a hermetic terminal 10 according to an Example 5 includes: a metal base 11 that is provided with three through holes and that is composed of stainless steel; leads 12 inserted in the respective through holes of metal base 11; and insulating members 13 that seal leads 12 in metal base 11 and that are each composed of soda barium glass. Each of leads 12 includes: a core member 12*a* composed of a Fe—Cr alloy; a binding member 12*b* that coats an outer diameter portion of core member 12*a* and that is composed of Ni; an intermediate member 12*c* that coats a surface of binding member 12*b* and that is composed of Al; and an outer coating member 12*d* that coats a surface of intermediate member 12*c* and that is composed of Ni.

As shown in FIG. 1 to FIG. 3, a hermetic terminal 10 according to an Example 6 includes: a metal base 11 that is provided with three through holes and that is composed of stainless steel; leads 12 inserted in the respective through holes of metal base 11; and insulating members 13 that seal leads 12 in metal base 11 and that are each composed of soda barium glass. Each of leads 12 includes: a core member 12*a* composed of a Fe—Cr alloy; a binding member 12*b* that coats an outer diameter portion of core member 12*a* and that is composed of Ag; an intermediate member 12*c* that coats a surface of binding member 12*b* and that is composed of Al; and an outer coating member 12*d* that coats a surface of intermediate member 12*c* and that is composed of Pd.

In the hermetic terminal according to the present embodiment, after sealing the lead in the metal base with glass, desired finishing plating can be further provided onto the metal surface. Moreover, for each of the core members described in the above-described Examples, any material may be used as long as a base structure for the intermediate member and the outer coating member can be formed. For example, the material of the core member is not limited to the Fe—Cr alloy, and may be a Fe—Ni alloy, carbon steel, or the like.

Moreover, for each of the insulating members described in the above-described Examples, any material can be used as long as the lead can be insulated from and hermetically sealed in the metal base. The material of the insulating member is not limited to the soda barium glass, and any glass material can be used therefor. As the insulating member, a resin material such as an epoxy resin may be used instead of the glass material in view of such a fact that the outer coating member of the present embodiment has a function of protecting the chemically weak intermediate member from interface erosion, corrosion, and the like. An insulating coating such as a silicone resin may be provided on each of portions of the lead and metal base of the hermetic terminal of the present embodiment.

The embodiments disclosed herein are illustrative and non-restrictive in any respect. The scope of the present invention is defined by the terms of the claims, rather than the embodiments described above, and is intended to include any modifications within the scope and meaning equivalent to the terms of the claims.

INDUSTRIAL APPLICABILITY

The hermetic terminal according to the present invention can handle particularly high voltage and high current, and can be used as a hermetic terminal for which high hermeticity is required.

REFERENCE SIGNS LIST

10: hermetic terminal; 11: metal base; 12: lead; 12*a*: core member; 12*b*: binding member; 12*c*: intermediate member; 12*d*: outer coating member; 13: insulating member.

The invention claimed is:

1. A hermetic terminal for feeding electrical power into a hermetically sealed housing comprising:

a metal base having a through hole;

a lead extending through the through hole of the metal base; and an insulating member that seals the lead in the through hole of the metal base; wherein the lead includes:

a core member serving as a structural member, a binding layer that coats at least an outer diameter portion of the core member, an intermediate layer that coats a surface of the binding layer and that is composed of a low-electric-resistance material, and an outer coating layer that coats a surface of the intermediate layer and that has a stable binding characteristic of binding to the insulating member at a sealing temperature; and the binding layer and the outer coating layer are composed of the same material.

2. The hermetic terminal according to claim 1, wherein the core member is composed of Fe or a Fe-based alloy.

3. The hermetic terminal according to claim 1, wherein the binding layer is composed of a metal selected from a group consisting of Ni, Cu, Ag, a Ni alloy, a Cu alloy, and an Ag alloy.

4. The hermetic terminal according to claim 1, wherein the low-electric-resistance material of the intermediate layer exhibits an electric resistance value less than an electric resistance value of a copper material.

5. The hermetic terminal according to claim 1, wherein the low-electric-resistance material of the intermediate layer is a metal composed of Cu or Al or an alloy including at least 5 weight % of at least one of Cu and Al.

6. The hermetic terminal according to claim 1, wherein the sealing temperature is at least 600° C. and at most 1100° C.

7. The hermetic terminal according to claim 1, wherein the insulating member consists of a glass material.

8. The hermetic terminal according to claim 1, wherein the insulating member consists of a resin material.

9. The hermetic terminal according to claim 1, wherein the outer coating layer has characteristics as result from forming the outer coating layer by plating or cladding a coating material of the outer coating layer onto the intermediate layer.

10. The hermetic terminal according to claim 1, wherein the outer coating layer consists of a coating material that has better adhesion than the low-electric-resistance material of the intermediate layer to an insulating material of the insulating member.

11. The hermetic terminal according to claim 1, wherein the binding layer consists of a binding material that has affinity to a core material of the core member and to the low-electric-resistance material of the intermediate layer, and is unlikely to be diffused into the core material and/or into the low-electric-resistance material.

12. The hermetic terminal according to claim 1, wherein the outer coating layer consists of a coating material that forms an oxide thereof on a surface of the outer coating layer, wherein the coating material and/or the oxide has a characteristic of slowly dissolving in an insulating material of the insulating member at the sealing temperature.

13. The hermetic terminal according to claim 1, wherein the low-electric-resistance material of the intermediate layer exhibits an electric resistance value comparable to an electric resistance value of a copper material.

14. The hermetic terminal according to claim 1, wherein the core member consists of an Fe—Cr alloy, the binding layer consists of Ni, the low-electric-resistance material of the intermediate layer consists of Cu, and the outer coating layer consists of a metal selected from the group consisting of Cr, Ni and Pd.

15. The hermetic terminal according to claim 1, wherein the core member consists of an Fe—Cr alloy, the binding layer consists of Cu, Ni or Ag, the intermediate layer consists of Al, and the outer coating layer consists of Cr, Ni or Pd.

16. The hermetic terminal according to claim 1, wherein:

the core member is composed of Fe or a Fe-based alloy, the binding layer is composed of a metal selected from a group consisting of Ni, Cu, Ag, a Ni alloy, a Cu alloy, and an Ag alloy, the low-electric-resistance material of the intermediate layer is a metal composed of Cu or Al or an alloy including at least 5 weight % of at least one of Cu and Al, and the outer coating layer is composed of one of metals composed of at least one of transition elements in groups 6A to 8 except for Tc in a long periodic table, or is composed of an alloy including at least 5 weight % of at least one of said metals.

17. The hermetic terminal according to claim 1, wherein the outer coating layer is composed of one of metals composed of at least one of transition elements in groups 6A to 8 except for Tc in a long periodic table, or is composed of an alloy including at least 5 weight % of at least one of said metals.

18. The hermetic terminal according to claim 17, wherein said metals composed of at least one of the transition elements, and the alloy including at least 5 weight % of at least one of said metals, are each composed of a metal selected from a group consisting of Cr, Ni, Ni—P, and Pd.

* * * * *